US005813444A

United States Patent [19]

Cashion

[11] Patent Number: 5,813,444

[45] Date of Patent: Sep. 29, 1998

[54] APPARATUS AND METHOD FOR FILLING A PLURALITY OF CONTAINERS WITH PARTICULATE MATTER

[76] Inventor: Donald P. Cashion, 7 Acres St., Box 114 School St., Bennington, N.H. 03442

[21] Appl. No.: 773,065

[22] Filed: Dec. 26, 1996

[51] Int. Cl.[6] ..... B65B 1/04; B65B 3/04; B65B 37/00; B67C 3/00

[52] U.S. Cl. ..... 141/248; 141/125; 141/237; 141/244; 141/247; 141/280; 141/286; 141/391; 47/901

[58] Field of Search ..... 141/121, 125, 141/126, 236, 237, 244, 245, 247, 248, 240, 280, 286, 363, 366, 370, 371, 391; 47/901

[56] References Cited

U.S. PATENT DOCUMENTS

| | | | |
|---|---|---|---|
| 1,790,626 | 1/1931 | Menninger et al. . | |
| 2,027,830 | 1/1936 | Krein | 226/93 |
| 2,720,351 | 10/1955 | Fleischer et al. | 226/41 |
| 3,693,673 | 9/1972 | Oates | 141/237 |
| 3,713,465 | 1/1973 | van Nobelen | 141/134 |
| 3,732,903 | 5/1973 | Oates | 141/237 |
| 4,020,881 | 5/1977 | Nothen | 141/1 |
| 4,363,341 | 12/1982 | Powell | 141/78 |
| 4,466,554 | 8/1984 | Hanacek et al. | 221/1 |
| 4,620,390 | 11/1986 | Mekler | 47/58 |
| 4,947,579 | 8/1990 | Harrison et al. | 47/1.01 |
| 4,972,886 | 11/1990 | Bernstein | 141/98 |
| 5,068,999 | 12/1991 | Visser | 47/73 |
| 5,139,059 | 8/1992 | Dierkes et al. | 141/237 |
| 5,254,140 | 10/1993 | Huang | 47/1.01 |
| 5,363,887 | 11/1994 | Haeberli | 141/12 |

*Primary Examiner*—David J. Walczak
*Assistant Examiner*—Timothy L. Maust
*Attorney, Agent, or Firm*—Daniel J. Bourque, Esq.; Kevin J. Carroll, Esq.

[57] ABSTRACT

A method for filling containers utilizing at least two filling members. The containers to be filled are placed in a receptacle and at least two filling members are placed over the containers with the apertures of the filling members corresponding to the openings of the containers to be filled. Particulate matter is then disposed on top of the filling members and passed through the apertures in the filling members filling the containers below. A scraper is used to push and/or pull the particulate matter off of one filling member onto the other filling member. The now clean filling member is removed and the containers which are now filled with particulate matter are removed as well. The particulate matter is then moved from the second filling member onto the first in order to fill the new containers under it. The second filling member now being cleared of particulate matter is removed and the containers under it which are now filled are then removed. Therefor, groups of containers may be filled with particulate matter without the necessity of removing the remaining particulate matter on the filling member.

8 Claims, 7 Drawing Sheets

APPARATUS AND METHOD FOR FILLING A PLURALITY OF CONTAINERS WITH PARTICULATE MATTER

FIELD OF THE INVENTION

The present invention relates to the filling of containers with particulate matter and more particularly, to an apparatus and method for filling a plurality of containers with particulate matter.

BACKGROUND OF THE INVENTION

In various industries, such as the floral and plant industry, the need to fill containers of varying sizes, such as flower pots, with material such as soil is an everyday occurrence. Accordingly, florists, plant dealers, and others need an efficient and cost effective way to fill containers including flower pots. In the past, one method for filling the containers was by hand, using a shovel, or other material transferring device, to transfer material from a wheelbarrow, or other material holding device, to the containers. While this method is satisfactory for low volume operations, it presents several problems for higher volume operations. This method is slow and potentially inefficient. Only one container will be filled at a time, and material may be spilled during the material transfer, or by over filling the container. This would result in wasted time and effort in having to pick up the material again. This method is, however, inexpensive in terms of the cost of the capital equipment required.

An example of a type of device that attempts to solve some of the above problems is one in which the containers to be filled are placed below a plate with apertures in it. These apertures in the plate correspond to the openings of the containers beneath them. Material is then pushed over the top of the plate, falling through the apertures into the containers, thus filling several containers at once. This is shown generally for example in U.S. Pat. Nos. 5,139,059; 4,972,886; 2,027,830; and 1,790,626. These patents disclose various cup filling distribution devices. In each disclosure however, the containers to be filled are supported in, or by, a frame with a plurality of compartments to support the containers in proper alignment with the apertures in the top plate. Thus, to fill a number of different sizes of flower pots would require a number of different size frames to support or hold the various containers and various plates with apertures of different sizes and layouts.

In addition, there is a further problem not addressed in the prior art. That is, what is to be done with the material remaining on the surface of the plate after the containers under the plate have been filled.

There are also devices to load flower pots on a much larger scale. For example, several prior art patents disclose highly complex machines for filling containers with particulate matter. One system utilizes two synchronated rotating bladed wheels to dispense soil from a hopper into flats of pots moving on a conveyor in a coordinated way beneath the wheels. Another system described in the prior art is one with two conveyors; one conveyer moving flower pots to the location where the filling occurs, and a second, vertical, conveyor with a step to hold earth to be placed into the pot. The vertical conveyor scoops dirt from below the plane of the flower pots to be filled in its scoop and transports the dirt above the plane of the pot to be filled and then dumps the dirt into the particular flower pot to be filled. This would allow flower pots of various sizes and shapes to be filled and would not require a number of frames. These are however, expensive to purchase, and also complex devices to use and maintain.

As shown above, the prior art solution to the problem of filling flower pots may be solved with devices of varying complexity. The simplicity of the shovel and wheelbarrow; the simple container filling devices wherein material is dropped into the containers to be filled through apertures in the plate thus filling several at once; and large complex machines for filling numerous containers at a time are all possible solutions. However, the prior art does not address the potential waste problem of material left on the surface of the plate after filling the containers.

Accordingly, what is needed is an apparatus and method for filling a plurality of containers that is economic, simple to operate, easy to maintain, allows containers of various sizes and shapes to be filled, and deals with the problem of material remaining on the surface of the plate after filling the containers beneath the plate.

SUMMARY OF THE INVENTION

The present invention features an apparatus and method for filling containers with particular matter. In the preferred embodiment, the apparatus for filling containers with particulate matter includes a receptacle for holding the containers to be filled, and at least two filling members which are placed on top of the containers in the receptacle. The filling members have a series of apertures, such that, when the filling members are placed on top of the containers, the apertures in the filling members are generally aligned with, and placed over, the corresponding openings in the containers to be filled. Particulate matter is then placed onto the filling members at least partially filling the containers below. The particulate matter may first be filtered through a grate or screen in order to reduce the size of pieces of the particulate matter to a given dimension. The particulate matter is moved or scraped from a first filling member onto at least a second filling member and the first filling member that is cleaned off is removed and the containers underneath it are removed having been filled with particulate matter.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
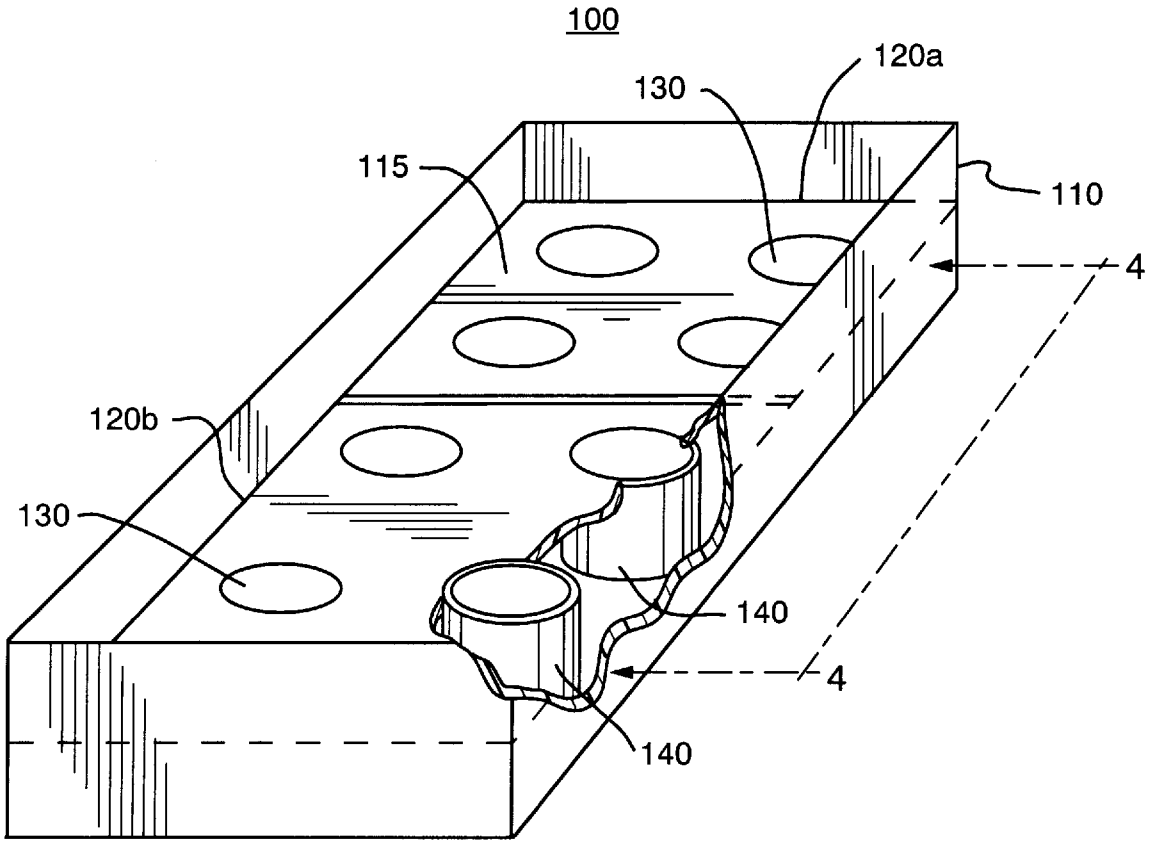
FIG. 1 is a perspective view of the apparatus for filling a plurality of containers with particulate matter according to the present invention with first and second filling members in place.

The apparatus for filling a plurality of containers 100, FIG. 1, according to the present invention comprises a receptacle or containment device 110 to hold a plurality of containers 140, with at least two filling members 120*a*, 120*b* being placed directly on top or proximate to the top of the containers 140. The filling members 120*a*, 120*b* include a plurality of apertures 130 which correspond generally to a plurality of openings in the containers 140.

The receptacle 110 may be any shape. In the preferred embodiment of the present invention, the receptacle 110 is generally rectangular in shape and sized to hold the desired number of containers 140. One example of a receptacle is approximately 2' wide, 8' long and approximately 2' deep. The receptacle 110 may be made of any structurally sound material such as plastic, wood or metal. In the preferred embodiment of the present invention, the receptacle is constructed of wood. The receptacle functions to hold the containers 140 and the walls of the receptacle 110 are sufficiently high such the particulate matter is not spilled outside the receptacle. The containers 140 may also be placed in a frame 150 as is well known in the potting industry.

Figure 2:
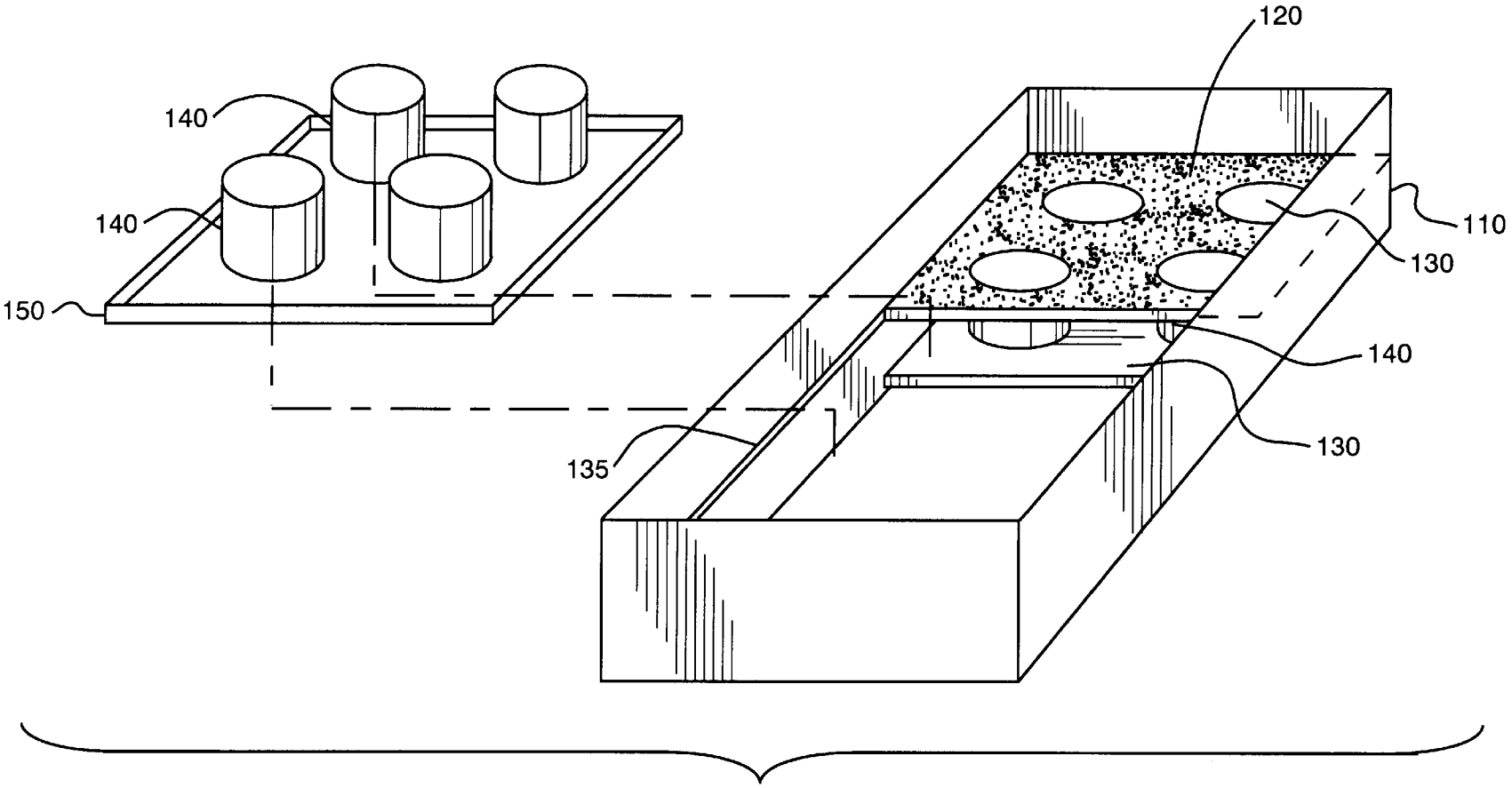
FIG. 2 is a perspective view of the apparatus for filling a plurality of containers with particulate matter according to the present invention with one of the filling members in place.

As shown in FIG. 1 and FIG. 2, the at least two filling members 120*a*, 120*b* should be of the same general shape as the receptacle 110. In the preferred embodiment where the receptacle 110 is generally rectangular, the at least two filling members 120*a*, 120*b* are approximately one-half the length of the receptacle, and slightly less than the width of the receptacle 110. The at least two filling members 120*a*, 120*b* may be made of any structurally sound material such as wood, plastic or metal and in the preferred embodiment, the at least two filling members 120*a*, 120*b* are made out of wood. The at least two filling members are disposed on top of the containers 140, or on rails 135 on the interior sides of the receptacle 110, and provide a surface 115 for the particulate matter to rest upon.

Figure 3:
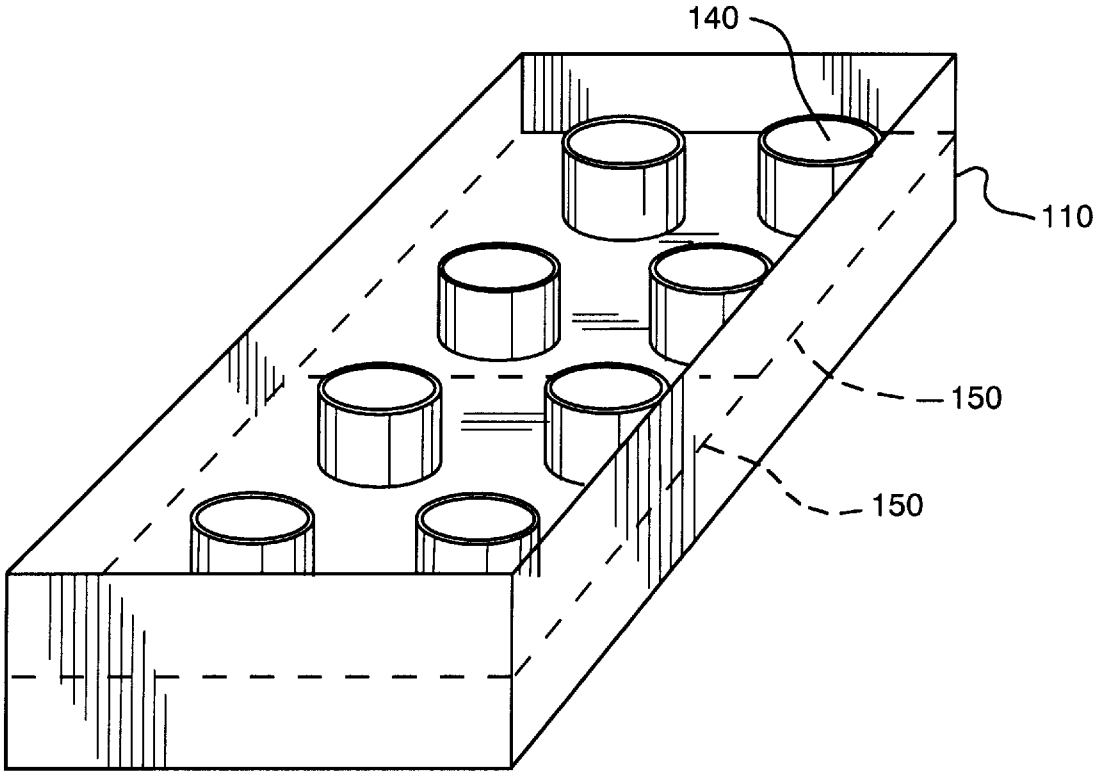
FIG. 3 is a perspective view of the apparatus for filling a plurality of containers according to the present invention with particulate matter with neither filling member in place.

As shown in FIGS. 2 and 3, a frame 150 may be used to hold the containers 140 in a particular orientation for a given pattern of aperture opening in the at least two filling members 120*a*, 120*b*. Additionally, a grate or screen (not shown) which may be used to filter the particulate matter as is well known in the art.

Figure 4:
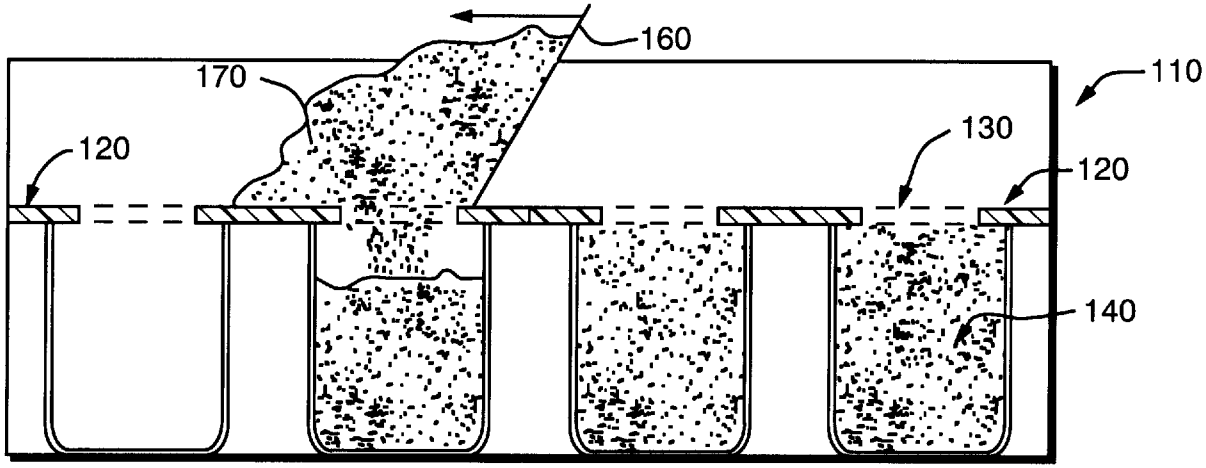
FIG. 4 is a sectional view along line 4—4 in FIG. 1.

The apparatus for filling a plurality of containers 100, FIG. 4, according to the present invention, utilizes a blade or scraper member 160 to push and/or pull the particulate matter 170 over the surface 115 of the at least two filling members 120*a*, 120*b*. This allows the particulate matter 170 to fall into the plurality of containers 140 generally filling them with the particulate matter 170.

The blade or scraper 160 may be of any convenient design and shape. In the preferred embodiment, the blade or scraper 160 is rectangular in shape, with a width that is slightly less than the width of the receptacle 110. The blade or scraper 160 may include a handle for manual operation, or may also be mechanically operated and fixed to the sides of the receptacle 110.

The blade or scraper 160 is able to move the particulate matter onto one of the at least two filling members 120*a*, 120*b*. This allows the other of the at least two filling members 120*a*, 120*b*, which is now free of particulate matter, to be removed. The filled containers 140 can be removed and replaced. The new empty containers, which replaced the previous containers, may be of a different size than the previous now filled containers 140. In addition, the replaced at least one filling member 120*a*, 120*b* may be an entirely different template from the previous at least one filling member.

Figure 5:
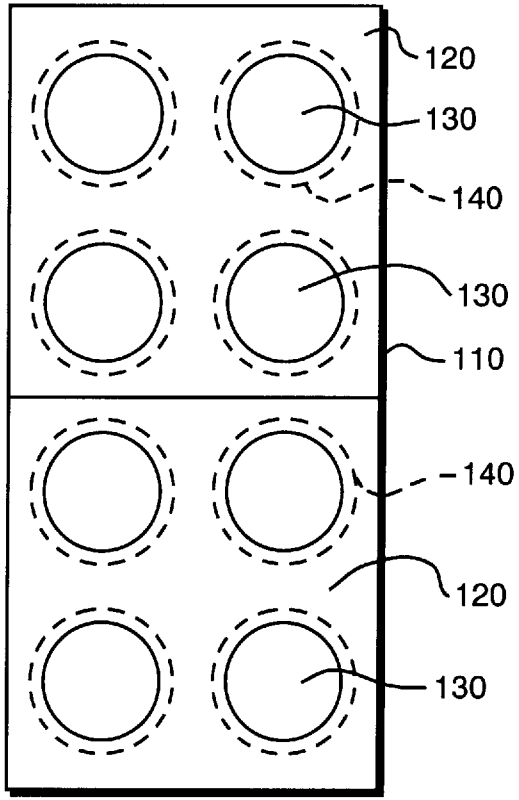
FIG. 5 is a view of the apparatus for filling a plurality of containers with particulate matter according to the present invention with a first and second filling member in place, showing the difference between the pot size and the aperture in the filling member.

As shown in FIG. 5, each of the at least two filling members 120*a*, 120*b* includes apertures 130. The apertures 130 are an opening in the filling member preferably corresponding to the shape of the openings in the containers 140. The pattern of the apertures 130 in the at least two filling members 120*a*, 120*b* may be any pattern such that the containers 140 may be placed under the filling member. In the preferred embodiment of the present invention, the pattern of the apertures 130 is a grid layout. The diameter of the apertures 130 is preferably smaller than the openings of the containers 140 in order to prevent spilling of the particulate matter 170 around the containers 140. In the preferred embodiment of the present invention, the aperture 130 is a round hole with a diameter that is approximately one-half inch more than one-half the diameter, in inches, of the opening of the container 140.

The containers 140 to be filled may be of any shape with any shaped opening. In the preferred embodiment of the present invention, the containers 140 are round flower pots. The containers 140 may be of any material such as plastic, wood, ceramic or metal. In the preferred embodiment the containers are made of plastic and ceramic.

The particulate matter 170 may be any particulate matter with which the containers 140 are to be filled. In the preferred embodiment, the particulate matter is potting soil.

A grate or screen may be used in order to filter the particulate matter prior to its being deposited on the at least two filling members 120*a*, 120*b* as is well known in the art. The grate openings should be the size of the maximum size of a desired conglomeration of the particulate matter 170.

Figure 6A:
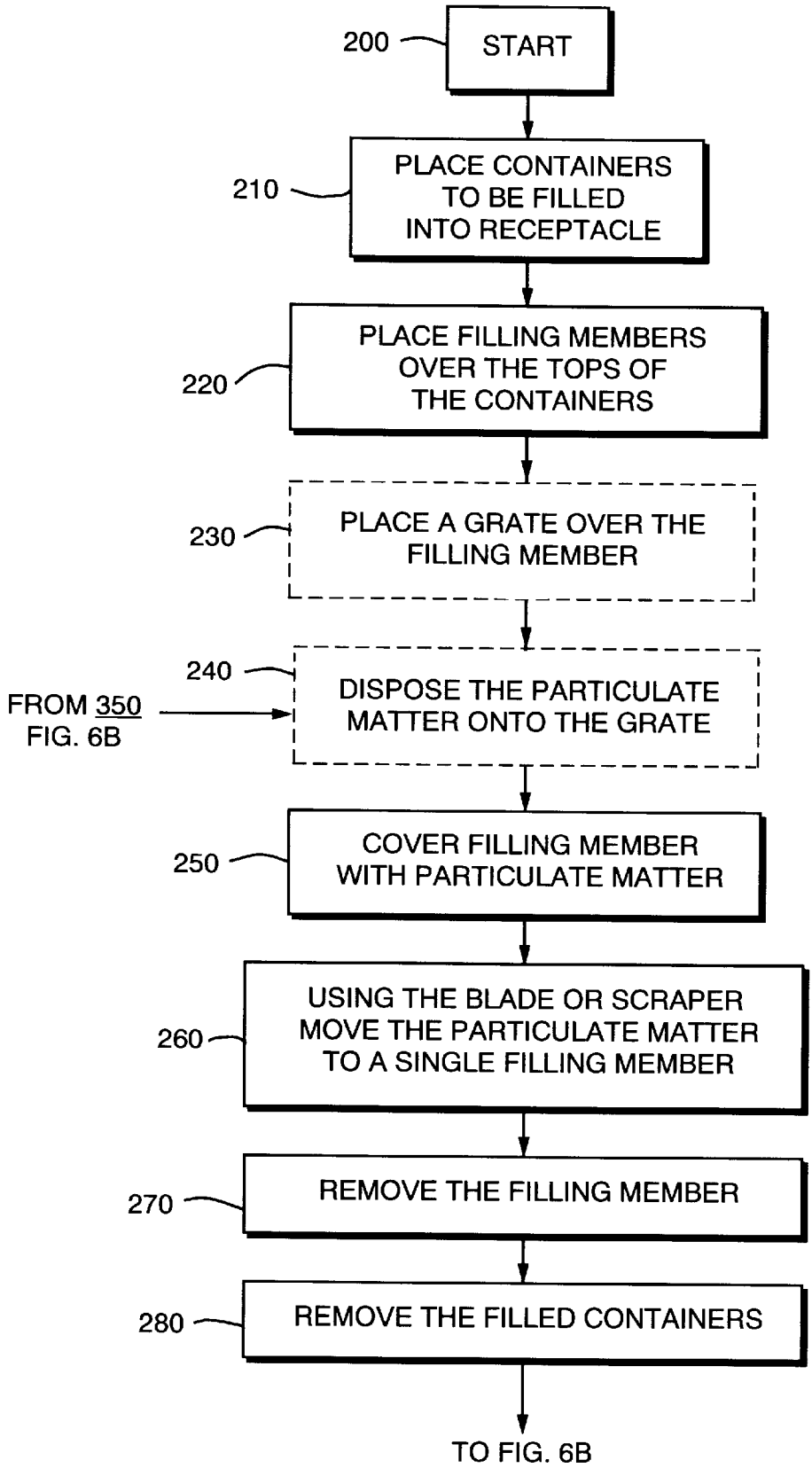
FIGS. 6A and 6B are a flowchart of the method for filling at least a first and second plurality of containers with particulate matter according to the present invention.
Figure 6B:
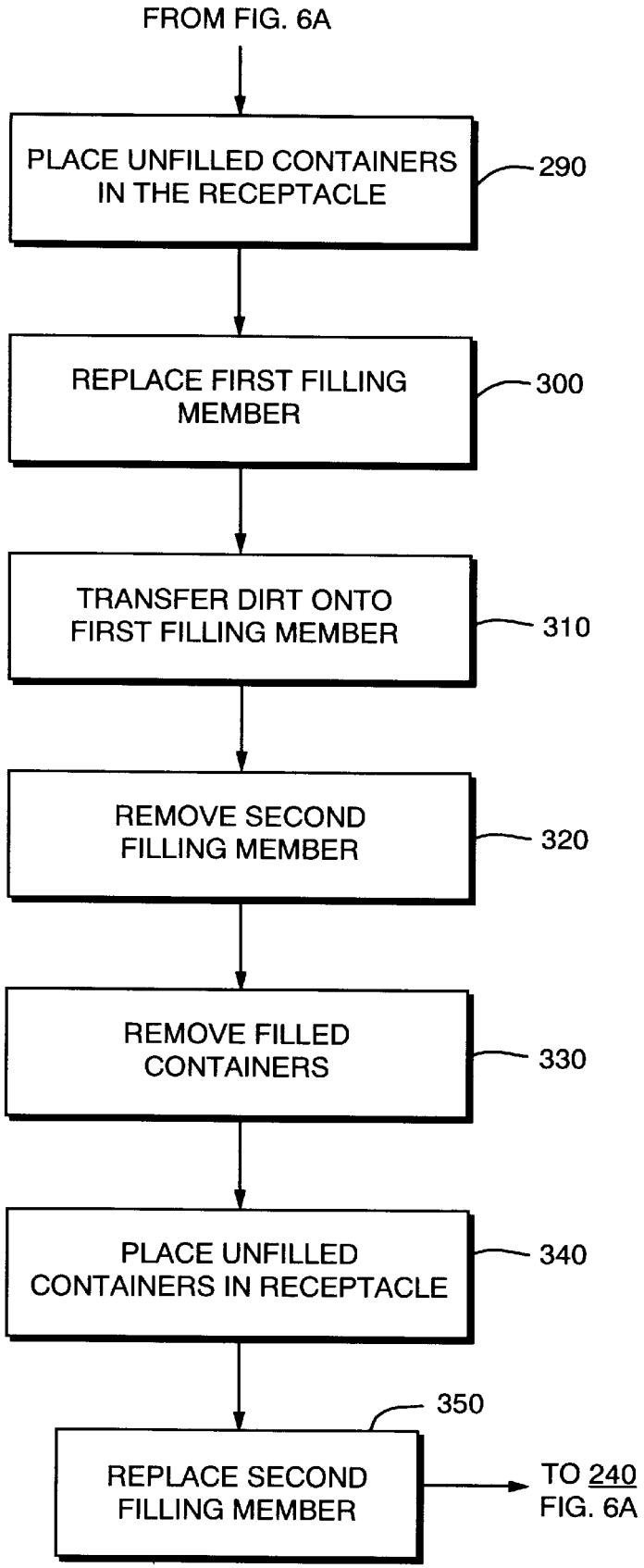

FIG. 6 is a flow chart of the method of utilizing the apparatus of the present invention. The containers to be filled 140 are first placed in receptacle 110, step 120. The corresponding at least two filling members 120*a*, 120*b* are placed over the containers, step 220. A grate may be optionally placed over the receptacle 110, step 230, to filter the particulate matter 170. Next, the particulate matter 170 is deposited onto the surface 135 of the two filling members 120*a*, 120*b*, step 240. This step may be repeated as often as necessary. Using the blade or scraper 160, the particulate matter 170 is transferred (pushed and/or pulled) from the first filling member 120*a*, step 250, onto the other filling member 120*b*, step 260. The first filling member 120*a* is removed, step 270, after which the now at least partially filled containers 140, which are located beneath the first filling member 120*a*, are removed, step 280. New unfilled containers 140, that may be of a different size than the previous set of containers 140, are placed in receptacle 110, step 290. A first filling member 120*a*, which may be different from the previously used first filling member 120*a*, corresponding to the new unfilled containers 140 is placed over the new containers 140, step 300.

The particulate matter 170 is then transferred from the second filling member 120*b* onto the first filling member 120*a*, step 310. The second filling member 120*b*, now free of particulate matter, is removed, step 320. The at least partially filled containers 140, located beneath the second filling member 120*b*, are removed from the receptacle 110, step 330. The next set of unfilled containers 140, which may be of a different size than the previous set of containers 140, are placed in receptacle 110, step 340. The second filling member 120*b* corresponding to the new unfilled containers 140 is placed over the new containers 140, step 350. This process may be repeated over and over as necessary.

The previously described embodiments of the present invention have many advantages. The preferred embodiment of the present invention being simply constructed and made of wood, is an economic method for filling a plurality of containers. In addition the present invention is extremely simple to operate and maintain. The present invention allows containers of various sizes and shapes to be filled and insures that no particulate matter is spilled, lost or wasted.

Modifications and substitutions by one of ordinary skill in the art are considered to be within the scope of the present invention which is not to be limited except by the claims which follow.

What is claimed is:

1. A container filling system for at least partially filling at least a first and second group of a plurality of containers with particulate matter, said container filling system comprising:

a receptacle, for receiving said at least first and second groups of plurality of containers, each of said plurality of containers having an opening, said receptacle having a bottom portion for supporting said plurality of containers;

at least first and second filling members, for positioning above said at least first and second groups of plurality of containers in said receptacle, said first and second filling members including a plurality of apertures, for allowing said particulate matter to pass through said plurality of apertures in said first and second filling members into a corresponding opening in said plurality of containers; and wherein said first and second filling members are positioned adjacent to one another in said receptacle above the corresponding at least first and second groups of said plurality of containers such that said first filling member, and said first group of containers under said first filling member having been filled with particulate matter are removable while said second group of containers under said second filling member are being filled with particulate matter.

2. The container filling system of claim 1, wherein said receptacle includes a generally rectangular box having a bottom portion, for supporting said plurality of containers, and four side portions.

3. The container filling system of claim 1 wherein, said at least first and second filling members comprise rectangular templates having a plurality of apertures for allowing said particulate matter to pass through said apertures in said at least first and second filling members into corresponding openings in said at least first and second groups of plurality of containers, said first and second filling members including side portions adjacent to at least two of said side portions of said receptacle, for generally containing said particulate matter.

4. The container filling system of claim 1 wherein said at least first and second filling members are disposed directly upon a top portion of said at least first and second groups of plurality of containers.

5. The container filling system of claim 1 further including a grate for filtering said particulate matter.

6. A method of filling a plurality of containers comprising the steps of:

loading at least first and second groups of pluralities of containers in a receptacle;

placing at least first and second filling members over respective at least first and second groups of plurality of containers such that said first and second filling members are adjacent one another;

disposing particulate matter over at least said first filling member;

moving said particulate matter across said first filling member allowing said particulate matter to pass through apertures in said first filling member into said first group of plurality of containers;

moving excess particulate matter to said second filling member; and removing said first filling member and said first group of filled plurality of containers.

7. The method of filling a plurality of containers as in claim 6 further comprising the steps of:

disposing additional particulate matter over said second filling member;

moving said excess particulate matter and said additional particulate matter across said second filling member allowing said particulate matter to pass through apertures in said second filling member into said second group of plurality of containers;

loading a new first group of plurality of containers into said receptacle;

placing first filling member over said new first group of plurality of containers;

moving excess particulate matter from said second filling member to said first filling member; and removing said second filling member and said second group of filled plurality of containers.

8. The method of filling a plurality of containers as in claim 6 further comprising the step of:

using a grate to filter said particulate matter prior to disposing said particulate matter over at least said first filling member.

* * * * *